US006592752B2

(12) United States Patent
Mathews

(10) Patent No.: US 6,592,752 B2
(45) Date of Patent: Jul. 15, 2003

(54) CLEANING SYSTEM FOR SWIMMING POOLS AND THE LIKE

(75) Inventor: Lester Mathews, Phoenix, AZ (US)

(73) Assignee: Caretaker Systems, Inc., Scottsdale, AZ (US)

( * ) Notice: Subject to any disclaimer, the term of this patent is extended or adjusted under 35 U.S.C. 154(b) by 0 days.

(21) Appl. No.: 10/323,041

(22) Filed: Dec. 18, 2002

(65) Prior Publication Data

US 2003/0085183 A1 May 8, 2003

Related U.S. Application Data

(63) Continuation-in-part of application No. 09/855,075, filed on May 14, 2001, now abandoned.

(51) Int. Cl.[7] ..... E04H 4/12

(52) U.S. Cl. ..... 210/97; 210/138; 210/169; 210/416.2; 4/490; 4/492; 73/170.01; 73/170.11

(58) Field of Search ..... 210/97, 138, 169, 210/416.2; 4/490, 492; 73/170.01, 170.11

(56) References Cited

U.S. PATENT DOCUMENTS 3,486,623 A 12/1969 Bosico
3,506,489 A 4/1970 Baker
3,615,013 A 10/1971 Reece
3,871,113 A * 3/1975 Crago et al.
4,114,206 A 9/1978 Franc
4,249,518 A * 2/1981 Holt
6,022,481 A 2/2000 Blake
6,345,645 B1 2/2002 Kenna et al.

* cited by examiner

*Primary Examiner*—Robert J. Popovics
(74) *Attorney, Agent, or Firm*—LaValle D. Ptak

(57) ABSTRACT

A recirculating pump system is connected to either skimmers, or a catch basin for a vanishing edge of a swimming pool, to supply water to the suction inlet of the pump system. A water distribution valve operated by an electric control system distributes water from the outlet side of the recirculating pump system to pool cleaning heads normally in accordance with a preprogrammed timed sequence. As part of each programmed cycle of operation of the water distribution valve, water is supplied to one or more pool return jets located on a side opposite the skimmer or catch basin. The return jets create moving surface currents on the water to sweep debris floating on or near the water surface to the skimmer or catch basin. An electric wind speed detector located in the vicinity of the pool and coupled to the electric control system causes the control system to override the programmed sequence in response to wind exceeding a pre-established threshold to operate the pump system to supply water to the pool return jets.

13 Claims, 2 Drawing Sheets

CLEANING SYSTEM FOR SWIMMING POOLS AND THE LIKE

RELATED APPLICATION

This application is a continuation-in-part of application Ser. No. 09/855,075 filed on May 14, 2001 now abandoned. This application also is related to application Ser. No. 09/452,350 filed Dec. 1, 1999, now U.S. Pat. No. 6,345,645, issued Feb. 12, 2002.

BACKGROUND

Many modern swimming pools are constructed with in-floor automatic cleaning systems. These systems substantially reduce, if not eliminate, the time which must be spent by pool owners or pool maintenance companies in cleaning the pools. Such cleaning systems typically include a plurality of spaced, retractable cleaning heads located at various positions in the bottom, walls and steps of the pool to effect indexed sweeping of the floor, walls and steps of the pool, with jets of water adjacent to and parallel to the surface surrounding the cleaning heads. This action moves dirt and debris which has settled onto the surface adjacent the heads away from the region being cleaned, and ultimately, toward the floor drain, and into suspension for removal through a surface skimmer or other structure, such as a "vanishing edge" catch basin. The operation of such a system utilizes a recirculating pump system for connecting the suction side of the pump to the water being drawn from the pool. The outlet side of the pump supplies the water through a filter. For systems utilizing in-floor cleaning systems, a water distribution valve is employed.

The water distribution valve has an inlet connected to the outlet of the pump/filter portion of the system, and utilizes a plurality of outlet ports for operating different banks of the cleaning heads which are located in the pool. Because relatively high pressures are required by the cleaning heads, it is not practical to operate all of the cleaning heads in a pool at the same time. Consequently, the water distribution valve operates the cleaning heads in different banks or groups, with a small number of the heads being functional at any given time. Each bank of heads is operated for a relatively short time, typically on the order of two to five minutes. The distribution valve then steps to the next bank of heads; and a similar length of time is used to operate those heads. The sequence is repeated throughout the total length of time required for cleaning the pool.

The fluid distribution valve disclosed in the above identified U.S. Pat. No. 6,345,645 is a highly efficient valve for effecting this operation. The fluid distribution valve of this co-pending application also is capable of operating different banks of the cleaning heads for different time intervals. This is not the case of most water distribution valves used in pool cleaning systems which require the dwell time, or the on time, for each bank of heads to be identical, irrespective of where the heads are located. For example, heads located on the steps of a pool typically require much less operating time than those located in the bottom or floor of the pool. The fluid distribution valve of the above identified co-pending application may be programmed to maximize the effectiveness of the dwell time for each different bank of heads for the most efficient cleaning of the pool. In addition, this valve may be operated to override a preset program to supply fluid to one or more of its outlets at times other than the preset times.

Automatic pool cleaning systems of the type described generally above are quite effective in removing dirt and debris from the pool. Over a period of time, heavier debris is removed through the bottom drain of the pool; and smaller particles are placed in suspension and moved to the surface of the pool, where they are removed by the skimmer or catch basin of a vanishing edge pool. Even though presently available automatic pool cleaning systems have been proven very effective, it still requires some length of time for floating debris, or debris near the surface of the water in the pool, either to sink to the bottom or to move from the end of the pool opposite the skimmer or catch basin to the skimmer or catch basin where it then can be removed from the pool.

The Bosico U.S. Pat. No. 3,486,623 is directed to a swimming pool recirculation and filtering system designed, in part, to remove floating debris from the surface of a pool by means of a series of nozzles located around three sides of the surface of the pool opposite the side which includes the skimmer. The nozzles are angled or directed for creating a flow of water on the surface of the pool toward the filter. The Bosico system shows a large number of nozzles, both near the surface of the pool and located in the below-water regions of the pool around the entire periphery, all simultaneously operated by a recirculating pump. While the representation of Bosico theoretically appears to represent an efficient pool cleaning system, it is entirely impractical, since the large number of nozzles employed would require an extremely high volume, high horsepower pump in order to effect the cleaning, even for a relatively small pool. Essentially, the system which is disclosed in Bosico is impractical from any reasonable consumer standpoint.

The Blake U.S. Pat. No. 6,022,481 also is directed to a pool cleaning system including, as a portion of the system, a skimmer which is operated by means of an entrainment nozzle discharging into the pool immediately beneath the surface entrance of water into the skimmer. In Blake, it is stated that the water from the entrainment nozzle enters the pool through a return tube as a diverging jet of water which expands in diameter. This jet then surfaces a few feet from the skimmer to produce surface currents which move away from the skimmer; although Blake further states that it is believed that the jet may improve the skimming action immediately adjacent the skimmer by creating a circulating movement of water to direct debris located a few inches from the skimmer into the skimmer. Clearly, a surface sweeping of the water surface of the pool from one end to the other, by means of some type of directive flow, is not disclosed in the Blake patent.

It is desirable to provide a cleaning system for swimming pools and the like which improves the efficiency of automatic pool cleaning systems, and which specifically facilitates the removal of floating debris or debris near the surface of the pool from the pool.

SUMMARY OF THE INVENTION

It is an object of this invention to provide an improved swimming pool cleaning system.

It is another object of this invention to provide an improved method for cleaning a swimming pool.

It is an additional object of this invention to provide an improved surface cleaning system and method for a swimming pool.

It is a further object of this invention to provide an improved surface cleaning system for a swimming pool which operates to create currents or movement of water along the surface of the water to move debris on or near the surface of the water toward skimmers or catch basins placed at the opposite end of the pool in response to wind or air movement which exceeds a predetermined threshold.

In accordance with a preferred embodiment of this invention, a cleaning system and method for a swimming pool is operated in conjunction with a recirculating pump system which has a suction water inlet and a water outlet the recirculating pump is operated in response to air movement or wind in excess of a predetermined threshold in the vicinity of the pool. A device is provided for supplying water from at or near the surface of the pool to the suction inlet of the recirculating pump system. At least one pool return outlet connected to the water outlet of the recirculating pump system is located to create movement of water along the surface of the water in the pool toward the device for supplying water to the suction inlet of the pump system. The system also may include at least one water delivery device located in the floor or wall of the pool, beneath the water, for placing dirt and debris in suspension in the water in the pool.

DETAILED DESCRIPTION

Reference now should be made to the drawings, in which the same reference numbers are used throughout the different figures to designate the same or similar components. Initially, reference should be made to FIGS. 1 and 2, which show a diagrammatic top view and a cross-sectional view, respectively, of a typical swimming pool.

Figure 1:
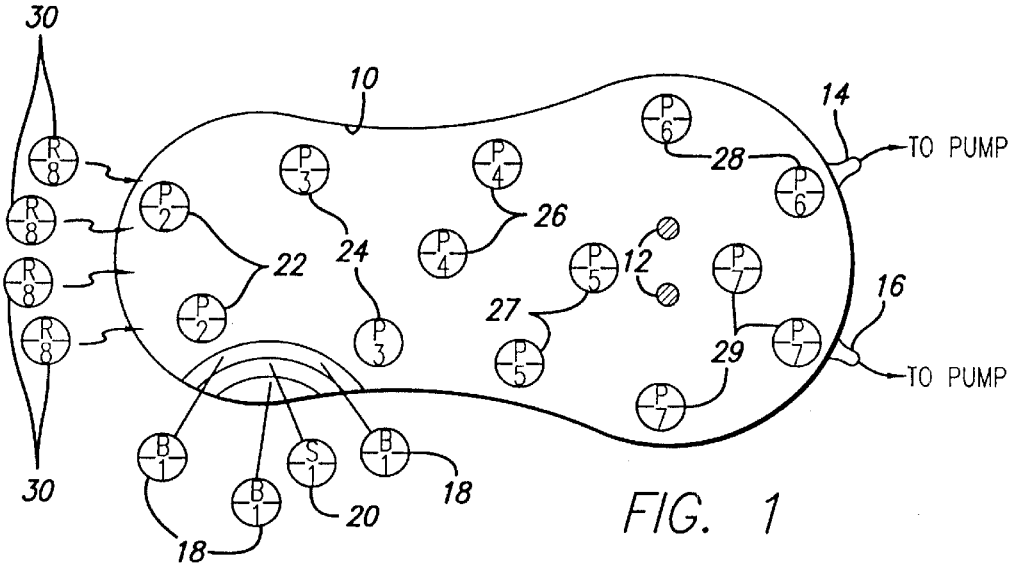
FIG. 1 is a top diagrammatic view of a swimming pool cleaning system incorporating a preferred embodiment of the invention.
Figure 2:
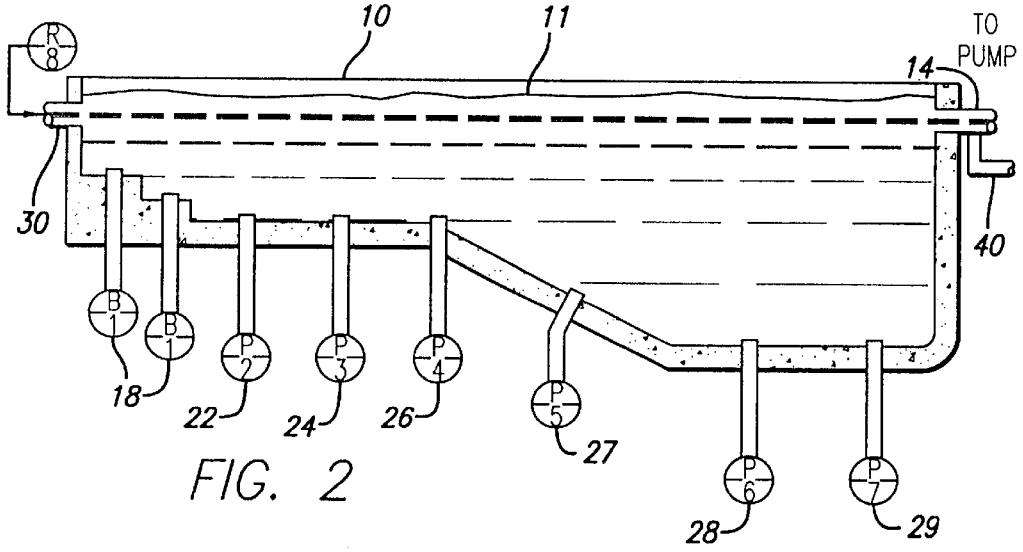
FIG. 2 is a diagrammatic cross-sectional view of a swimming pool cleaning system incorporating a preferred embodiment of the invention.

The swimming pool 10 generally has a deep end and a shallow end, as seen most clearly in FIG. 2, and is filled with water to a water level 11 near the top edge of the pool. In a pool which is utilizing an automatic in-floor cleaning system using pop-up indexed cleaning heads, the cleaning heads are located at various positions in the bottom and steps of the pool, as indicated in FIG. 1. The locations of the different cleaning heads are designated by the designations P2 through P7, B1 and S1, carrying the reference numbers 22, 24, 26, 27, 28, 29, 18 and 20 for different groups or banks of cleaning heads. For example, there are two cleaning heads in the group or bank P2 designated by the reference number 22. There are three cleaning heads in the group or bank P7, designated by the reference number 29; and there are three cleaning heads in the bench or step group or bank B1 and carrying the reference number 18. The pool shown in FIG. 1 also has a pair of spaced floor drains 12 in the deepest portion of the pool and, at the deep end, a pair of conventional surface skimmers 14 and 16 located at the right-hand end of the pool, as illustrated in FIGS. 1 and 2.

In addition to the in-floor cleaning system heads designated by the reference numbers 18, 20, 22, 24, 26, 27, 28 and 29, there are four spaced-apart return inlets R/8 carrying the reference number 30. These are located at the left-hand end of the pool shown in FIGS. 1 and 2, or at the opposite end from the skimmers 14 and 16.

Figure 3:
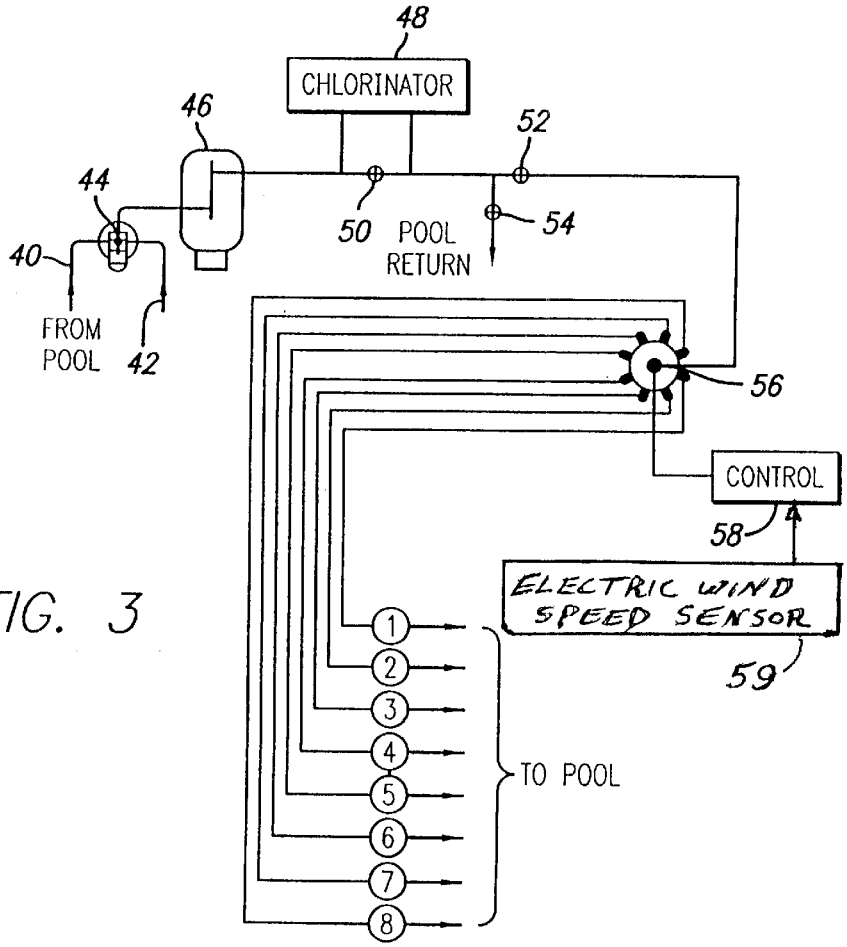
FIG. 3 is a diagrammatic representation of a recirculating pump system employed in conjunction with the embodiment shown in FIGS. 1 and 2.

In the operation of the pool of FIG. 1, a recirculating water supply is utilized. A preferred arrangement of such a water supply is shown in FIG. 3. This recirculating water supply includes a pump 44, the vacuum side of which is connected to lines such at the lines 40 and 42 connected, respectively, to the skimmers 14 and 16 and the floor drains 12. This is the water which is pulled into the suction inlet of the pump 44 to remove the water from the pool for filtration and recirculation. The outlet side of the pump 44 is connected to a filter 46 which may be any one of a number of standard pool filter configurations.

Water flowing from the output of the filter 46 then either may pass directly through an open valve 50, or, if the valve 50 is closed, through a chlorinator 48 for chemically treating the water passing out of the filter 46, from which the water is directed back to the pool. Two other valves 52 and 54 determine the path which will be taken by the water coming from the outlet side of the pump 44 and the filter 46. If the valve 52 is closed and the valve 54 is open, all of the water will return to a single (or plurality) pool return inlet into the pool, bypassing the in floor cleaning system described above in conjunction with FIGS. 1 and 2. If the valve 54 is closed and the valve 52 is open, all of the water passing out of the filter 46, whether directly through the valve 50 or through the chlorinator 48, is supplied to a water distribution valve 56, shown as having eight different outlet pipes or banks numbered 1 through 8 in the bottom of FIG. 3.

The water distribution valve 56 ideally is of the type disclosed in the above mentioned U.S. Pat. No. 6,345,645. The basic operation of the valve 56 is that the water supplied to the inlet of the valve, such as through the valve 52, is directed through each of the outlet ports one at a time. Thus, the outlet ports 1 through 8 individually receive the full output of the recirculating pump 44 at any given time when the recirculating system is in operation.

In the system shown in FIG. 3, an electric control circuit 58 controls the dwell time of the water distribution valve 56 according to the above mentioned co-pending application; so that the time at which the water is supplied under pressure to each of the outlet ports 1 through 8 may be varied in accordance with the use of, and location of, those ports. For example, port No. 1 of the valve 56 is illustrated in FIGS. 1 and 2 as connected to the bench cleaning heads Bi, designated by the reference number 18, and shown in FIG. 1 in conjunction with the steps of the pool. Since the cleaning of steps and benches requires cleaning of only a relatively small area, the dwell time of the water distribution valve 56 on port.1 may be considerably less than the dwell time for other ports. With respect to ports 2 through 7, it is apparent from an examination of FIGS. 1 and 2 that the cleaning heads connected to these ports are located at various positions in the bottom of the pool. Each of the outlet ports of the valve 56 are connected to different numbers of cleaning heads, such as the two heads 22 connected to port 2, and the three heads 29 connected to port 7. These different ports are all designated in FIGS. 1 and 2 as P/2 through P/7 in conjunction with cleaning head locations; and it is readily apparent where the different banks of heads 22 through 29 are located.

It should be noted that the cleaning heads connected to the lower numbered ports, 2, 3 and 4, are located at the shallow end of the pool; whereas the ports 5, 6 and 7 are connected to heads located in the deeper portions of the pool. The number of cleaning heads on each of these ports is shown as two in FIG. 1, with the exception of port 7, which is designated by reference No. 29. Port 7 is connected to three heads 29 located at the deepest end of the pool. The actual number of heads on each of the ports may be varied in accordance with the capacity of the pump 44 and the design or layout of the pool.

Figure 4:
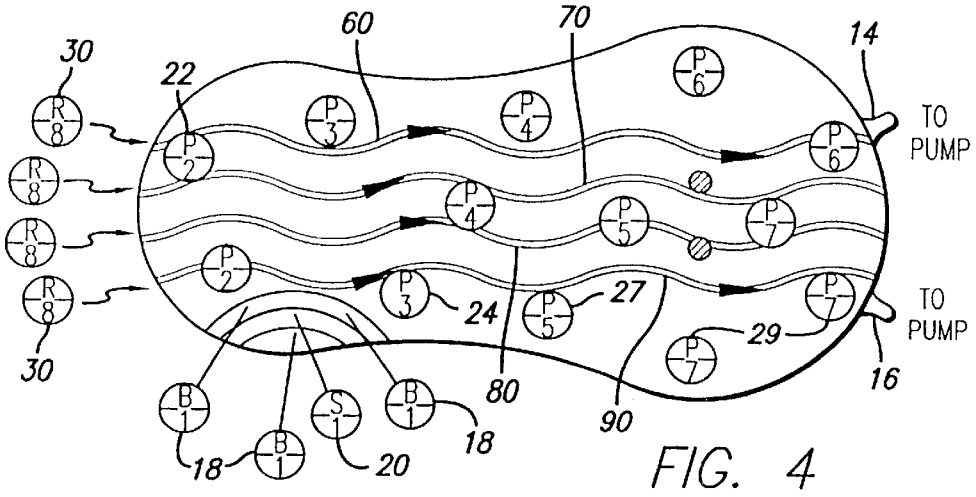
FIG. 4 is a top diagrammatic view of the same pool shown in FIG. 1 illustrating the manner of operation of the preferred embodiment of the invention.

In addition to the cleaning system which has been described generally above, the pool of FIGS. 1 and 2, and illustrated in additional detail in FIG. 4, includes four pool return outlets or pool return jets 30, designated as R/8 in FIGS. 1, 2 and 3. These pool return jets are spaced substantially uniformly apart from one another, in parallel, near the surface of the pool, at the end opposite the skimmers 14 and 16. These return jets 30 are coupled to port 8 of the distribution valve 56 and they are directed parallel to the surface 11 of the water. The jets 30 also are pointed generally toward the opposite end of the pool where the skimmers 14 and 16 are located.

Whenever the jets 30, connected to the port 8 of the distribution valve 56, are supplied with water through the water recirculation system, currents of water, illustrated as 60, 70, 80 and 90 in FIG. 4, are formed moving from the left-hand end of the pool as viewed in FIGS. 1, 2 and 4, toward the right-hand end. The water currents 60, 70, 80 and 90 move surface debris, and debris located near the surface, from the left-hand or shallow end of the pool toward the surface at the deep end or right-hand end of the pool, as illustrated in FIGS. 1, 2 and 4. This facilitates the removal of surface debris from the pool by the skimmers 14 and 16; so that this debris may be passed through the recirculation and filtration system to be filtered out of the pool water at 46 in conjunction with the recirculating system shown in FIG. 3.

It should be noted that if a sufficiently high pressure, large volume pump 44 is employed, both of the valves 52 and 54 may be to the water return jets 30 in place of supplying water to these jets through port 8 of the distribution valve 56. While this is a possibility, provided a sufficiently high capacity pump 44 is employed, the typical situation has the valve 54 closed and the valve 52 opened to cause the water return jets 30 to be supplied from the eighth port of the water distribution valve 56.

As mentioned previously, the ideal or preferred water distribution valve 56 is constructed in accordance with the valve disclosed in the above mentioned U.S. Pat. No. 6,345,645. This valve includes the capability of adjusting the dwell time at each of the outlet ports under the control of the timer control 58, shown in FIG. 3. Typically, an automatic pool cleaning system of the type described operates to conduct a normal cleaning of the entire pool through the outlets 18 through 29 by sequentially stepping the water distribution valve 56 to each one of its different outlet ports. The duration of time any of the ports is supplied with water from the distribution valve 56 is on the order of one or two minutes for each of the cleaning heads identified by the reference numbers 18 through 29. As mentioned previously, the dwell time at each of these different ports may be varied, with the shortest dwell time being effected for the bench and step heads 18 and 20; and a greater dwell time being selected for the heads located in the bottom of the pool, such as 28 and 29 at the deep end. The most effective time interval for maximizing the cleaning operation may be selected, since the time at which water under pressure is supplied to each of the different outlet ports of the preferred distribution valve. 56 may be varied by the control system 58 in accordance with the demands of the system. Because of the desire to create relatively strong currents 60, 70, 80 and 90 across the entire length of the pool, the port 8 from the distribution valve 56, which is connected to the water return jets 30, may be adjusted to sweep the surface for a greater length of time than the time water is supplied to any of the other banks of cleaning heads. The amount of time at which all of the different outlet ports from the distribution valve 56 may be operated is controlled through a programmed setting of a timer in the control system 58.

Frequently, swimming pools are located in backyards or parks, or other locations adjacent trees and bushes and other vegetation. The leaves which fall from such trees and bushes, either directly into the pool or on the ground adjacent the pool, from which they are blown into the pool by winds or breezes, form a typical debris, along with wind-blown dust which settles onto the top of the pool surface. It is this floating debris which is moved across the surface of the pool by the jets 30 to the skimmer or catch basin at the end of the pool for removal by the system described above. The amount of such wind-blown debris, whether it is leaves or dust, or the like, increases during the presence of wind in the vicinity of the pool. This wind strips leaves from the trees and other vegetation and blows surrounding dust and other debris into the pool. Consequently, during the time at which wind over some a threshold exists, the amount of debris deposited on the top of the pool is greater than at times when there is little or no wind. As a result, it is desirable to operate the water return jets 30 for creating the surface currents shown in FIG. 4 during the time of such excess wind, irrespective of the pre-established programmed cycle of operation of all of the eight outlets depicted in FIG. 3 for the water distribution valve 56. In order to maximize the cleaning effect of the system which has been described previously, the system additionally includes an electric wind speed sensor device or system 59, which provides an electrical output whenever the wind speed sensed by the sensor 59 exceeds a pre-established threshold.

For example, if the pool shown in FIGS. 1,2 and 4 is located in an area where adjacent vegetation and surfaces surrounding the pool discharge debris into the pool when a wind or a breeze exists, the wind speed sensor 59 may be set by the pool owner or operator to provide an output signal to the valve control system 58 to cause the system 58 to override its pre-established program and divert all of the water flowing through the valve 56 from its inlet to the outlet port 8, which is connected to the water return jets 30 shown in FIGS. 2 and 4. The control system 58 is designed to maintain the operation of the valve 56 in this condition, namely interconnected to the outlet port 8 supplying the water jets 30 for a length of time following the cessation of the wind threshold signals from the wind speed sensor 59. This time is chosen to be sufficient to allow the water currents shown in FIG. 4 to move from one end of the pool, the left end, to the right-hand end, to effectively sweep the major portion of the debris which has been deposited on the pool surface during the time that the wind was present. This operation of an override of the programmed sequence of operation of the valve 56 is effected every time the electric wind speed sensor 59 senses a breeze or a gust of wind in excess of the threshold which has been established for operation in that particular location.

It should be noted that one or more skimmers 14 and 16 may be utilized. As shown in FIGS. 1 and 4, in particular, two such skimmers are shown. The skimmers, such as the skimmers 14 and 16, are located to receive debris from the strategically located water return jets 30. The number of skimmers may be varied in accordance with the size of the pool and/or the configuration of the pool. If the pool is a "dog leg" shape, for instance, two banks of returns, such as the return jets 30, may be employed in place of connecting all of the jets on a single port of the valve 56 such as the port 8 illustrated in the drawing. In such a dog leg pool, the output of one of these ports could be used to clean one portion of the pool while the other would clean the "dog leg" portion. The operation of the overall system, however, is identical for such a pool configuration.

The foregoing description has been made in conjunction with the utilization of skimmers 14 and 16 for supplying water from the surface of the pool to the inlet side of the recirculating pump 44. Many pools being constructed today do not employ skimmers such at the skimmers 14 and 16, but utilize what is called a "vanishing edge". This means that a section (typically, one end) of the pool has an area which allows water to overflow the edge of the pool into a catch basin. The catch basin acts in the same manner as the skimmers of an older more conventional pool to supply water to the vacuum inlet of the pump 44. Consequently, it should be understood that where the reference has been made to skimmers 14 and 16 in conjunction with the foregoing description and the drawings, the skimmers 14 and 16 may be replaced by such a catch basin. The operation of the system is identical for either type of pool. In fact, the "vanishing edge" type of pool lends itself particularly well to the utilization of the surface cleaning system using the water return jets 30, described above in conjunction with FIGS. 1 through 4.

The foregoing description of the preferred embodiment of the invention is to be considered as illustrative and not as limiting. Various changes and modifications will occur to those skilled in the art for performing substantially the same function, in substantially the same way, to achieve substantially the same result, without departing from the true scope of the invention as defined in the appended claims.

What is claimed is:

1. A cleaning system for a swimming pool having first and second opposite ends including in combination:

a recirculating pump system having a suction water inlet and at least one water outlet;

a device at the first end of the pool for supplying water from substantially the surface of the water in the pool to the suction water inlet of the recirculating pump system;

at least one pool return outlet at the second end of the pool connected to the at least one water outlet of the recirculating pump system and located to create movement of water along the surface of the water in the pool from the second end of the pool toward the device at the first end of the pool for supplying water from substantially the surface of the water in the pool to the suction water inlet of the pump system;

an electric wind speed indicator located to sense air movement in the vicinity of the swimming pool and coupled with the recirculating pump system for causing operation of the recirculating pump system to recirculate water from the suction water inlet thereof to the at least one water outlet thereof in response to air movement above a predetermined threshold.

2. The cleaning system according to claim 1 wherein the recirculating pump system operates to recirculate water from the suction inlet thereof to the at least one water outlet thereof for a predetermined time interval following the presence of air movement above the predetermined threshold.

3. The cleaning system according to claim 2 further including a water delivery device located in the floor or wall of the pool, wherein recirculating pump system includes a plurality of water outlets and a water distribution valve for alternately supplying water through selected ones of the water outlets to the water delivery device and the at least one pool return outlet.

4. The cleaning system according to claim 3 wherein the at least one pool return outlet is a plurality of pool return outlets located at spaced intervals from one another near the surface of the water at the second end of the pool.

5. The cleaning system according to claim 4 wherein the control system has an operating program to operate the water distribution valve to supply water to the water delivery device for a first predetermined period of time, and to supply water to said at least one pool return outlet for a second predetermined period of time; and wherein the device responsive to air movement above the predetermined threshold causes the control system to override the operating program.

6. The cleaning system according to claim 5 wherein the device for supplying water from substantially the surface of the pool to the suction inlet of the recirculating pump system comprises a catch basin of a vanishing edge pool.

7. The cleaning system according to claim 5 wherein the device for supplying water from substantially the surface of the pool to the inlet of the recirculating pump system is a pool skimmer.

8. The cleaning system according to claim 2 further including a water delivery device located in the floor or wall of the pool, wherein recirculating pump system includes a plurality of water outlets and a water distribution valve for alternately supplying water through selected ones of the water outlets to the water delivery device and the at least one pool return outlet.

9. The cleaning system according to claim 8 wherein the at least one pool return outlet is a plurality of pool return outlets located at spaced intervals from one another near the surface of the water at the second end of the pool.

10. The cleaning system according to claim 9 wherein the control system has an operating program to operate the water distribution valve to supply water to the water delivery device for a first predetermined period of time, and to supply water to said at least one pool return outlet for a second predetermined period of time; and wherein the device responsive to air movement above the predetermined threshold causes the control system to override the operating program.

11. The cleaning system according to claim 1 wherein the device for supplying water from substantially the surface of the pool to the inlet of the recirculating pump system is a pool skimmer.

12. The cleaning system according to claim 1 wherein the device for supplying water from substantially the surface of the pool to the suction inlet of the recirculating pump system comprises a catch basin of a vanishing edge pool.

13. The cleaning system according to claim 1 wherein the at least one pool return outlet is a plurality of pool return outlets located at spaced intervals from one another near the surface of the water at the second end of the pool.

* * * * *